United States Patent [19]

Johansson

[11] Patent Number: 4,572,373

[45] Date of Patent: Feb. 25, 1986

[54] MEDICINE CUP

[76] Inventor: Jan-Erik Johansson, Räfsta, S-186 00 Vallentuna, Sweden

[21] Appl. No.: 601,767

[22] Filed: Apr. 18, 1984

[30] Foreign Application Priority Data

Apr. 22, 1983 [SE] Sweden ..... 8302292

[51] Int. Cl.[4] ..... B65D 21/02; B65D 21/04

[52] U.S. Cl. ..... 206/515; 206/508; 206/509; 206/519; 206/820

[58] Field of Search ..... 206/515, 519, 520, 217, 206/820, 508, 509

[56] References Cited

U.S. PATENT DOCUMENTS

| | | | |
|---|---|---|---|
| 2,352,684 | 7/1944 | Braddock | 206/515 |
| 2,401,038 | 5/1946 | Barton | 206/217 |
| 2,493,633 | 1/1950 | Mart | 206/519 |
| 2,971,304 | 2/1961 | O'Neil | 206/515 |
| 3,054,679 | 9/1962 | Bradford | 206/820 |
| 3,186,850 | 6/1965 | Anthony | 206/217 |
| 3,206,017 | 9/1965 | Williams | 206/820 |
| 4,061,782 | 12/1977 | Baxter | 206/217 |

FOREIGN PATENT DOCUMENTS

| | | | |
|---|---|---|---|
| 1325230 | 8/1973 | United Kingdom | 206/515 |

*Primary Examiner*—George E. Lowrance

*Attorney, Agent, or Firm*—Pollock, Vande Sande and Priddy

[57] ABSTRACT

A pileable cup provided with a lid, particularly intended for portioning medicine in solid state, consists of an outer wall conically tapering from an open bottom, the outer wall at an upper edge being folded into an inner wall conically tapering towards the open bottom, which inner wall merges into a closed bottom which is spaced apart from said open bottom inside the outer wall. The lid abuts adhesively but removeably against said upper edge and forms together with the inner wall and the closed bottom a space for the medicine. Inside the upper edge the lid is provided with an underlayer of a non-adhesive material. The lid preferably consists of a layer of white paper provided with an adhesive material and an underpaper which can be silicone-treated. Data of patients and kinds of medicine can easily and quickly be printed or otherwise marked on the lids.

6 Claims, 6 Drawing Figures

MEDICINE CUP

The present invention relates to a pileable cup, particularly intended for portioning solid medicine to patients in hospitals or the like.

It is previously known to use for such portioning small plastic cups which usually are formed conically upwards extending from bottom to open end. For closing the cup there is provided a lid provided with a downwardly directed flange, which is forced over the open end. Data about the patient in question is usually written on the lid with Indian ink pen. A disadvantage with such a cup is that the marking with the Indian ink pen is time-consuming and can also be difficult to read and therefore there is also a risk for wrong-reading. Another great disadvantage is that such cups often are not pileable and therefore cups for one patient who shall have several medicines require comparatively large room both when preparing cups with medicines for patients in a hospital department and when distributing the cups. Also because of this multiplicity of separate cups there is a certain risk for wrong distribution.

Said disadvantages are eliminated by the present invention. Cups formed in accordance with the invention can be securely and firmly piled on each other both without lids, e.g. for appropriate delivery and storing, and with lids so that different medicines for a patient can be placed in different cups above each other in a pile. The lids can be mass-produced easily and quickly and the clear printing or stamping of required data for different patients can easily be made on the lids.

An embodiment of a cup according to the invention is in the following described more in detail with reference to the accompanying drawings, in which.

Figure 1:
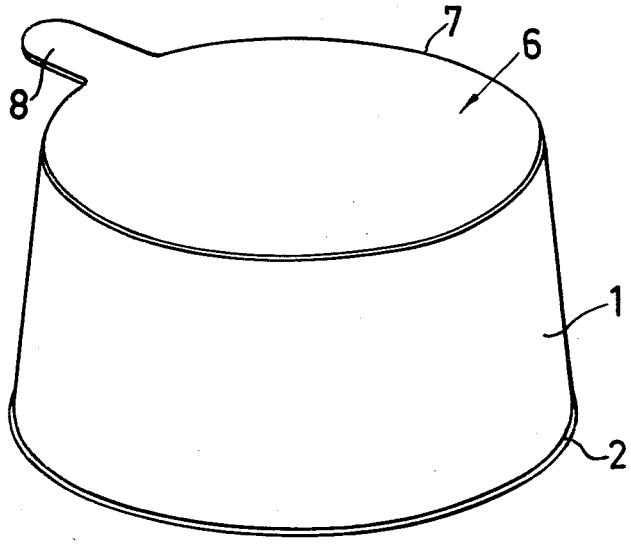
FIG. 1 is a perspective view showing the cup according to the embodiment.
Figure 2:
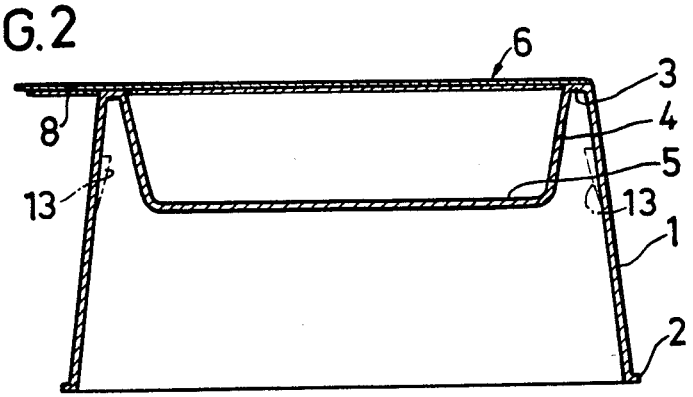
FIG. 2 is a central section through the cup.

As shown in FIGS. 1 and 2 the illustrated cup consists of an outer wall 1 which from a lower edge 2 around an open bottom conically decreases towards the upper edge 3 where the outer wall 1 merges into a downwardly extending inner wall 4 which conically decreases towards and merges into a closed bottom 5. As shown in FIG. 2 the plane of closed bottom 5 is parallel to the plane defined by lower edge 2 of the open bottom, and said closed bottom 5 is spaced from the plane of said open bottom by a distance that is at least one-half of the total distance between the plane of the open bottom and upper edge 3. A lid 6 is adheringly but removeably positioned against the upper edge 3 and said lid consists of a circular closing part 7 and a grip tap 8 projecting outside the outer wall 1. The closing part 7 of the lid, the inner wall 4 and bottom 5 define a closed space for medicine in solid state, for which the illustrated cup is particularly intended to be used.

FIG. 2 also shows with dashed lines shoulders 13, e.g. four shoulders evenly distributed around the inside of the wall 1. These shoulders are arranged for facilitating the removal of piled cups from each other, particularly when the cups without lids are piled on each other (see FIG. 6).

Figure 3:
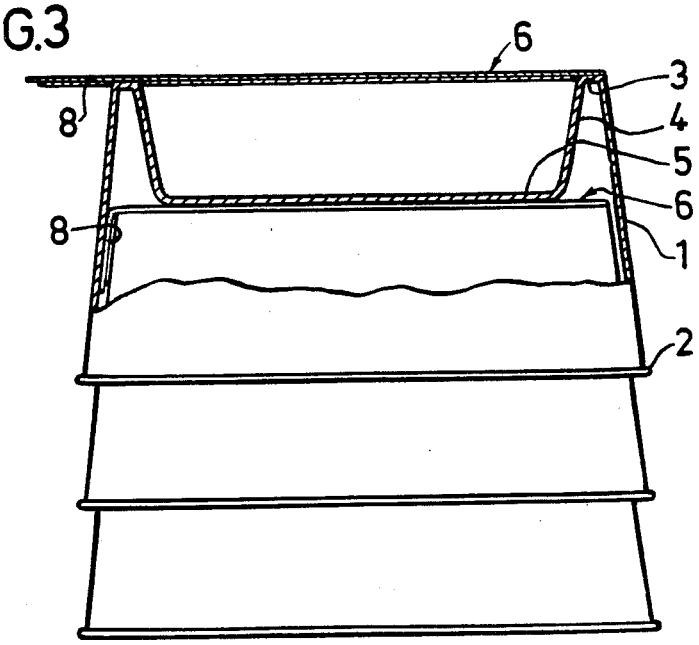
FIG. 3 is a view, partly in section, illustrating several cups piled on each other.

As illustrated in FIG. 3 the configuration of the cup allows a stable piling of cups above each other, wherein the bottom 5 of one cup may come into abutment against the lid 6 of the underlying cup, as shown, or above the lid depending on said conicity and the outer wall 1 of the underlying cup abuts against the inside of the outer wall 1 of the above positioned cup. Upon the piling the grip tap 8 of the lid will be bent down and abut against the inside of the outer wall 1 of the cup positioned above.

The inner wall 4 is for reasons of manufacture in the illustrated embodiment conically tapering downwardly but can for forming the space for the medicine also have another configuration with maintained piling ability. From a stability point of view the bottom 5 should be plane and parallel with the lid 6 although the bottom can be formed in another way without loosing the piling ability.

Figure 4:
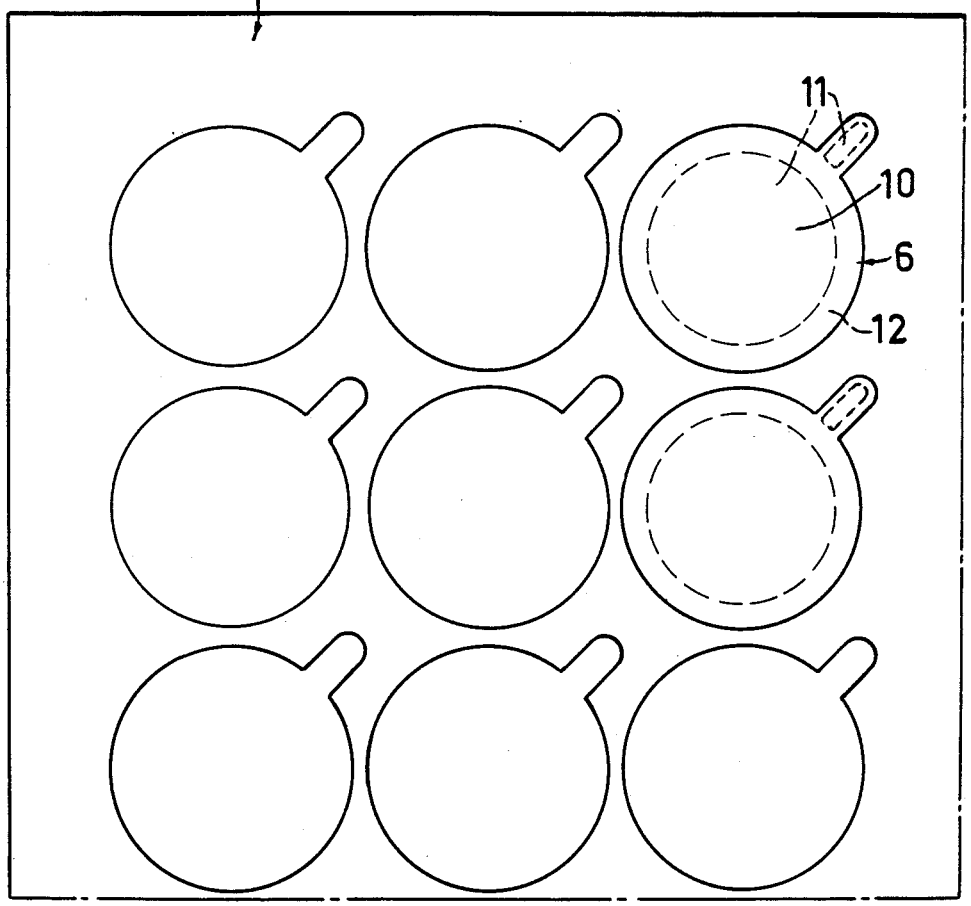
FIG. 4 is a view illustrating a sheet for manufacturing lids to the cups.

FIG. 4 illustrates a preferred manufacturing of lids 6. In sheet 9 consisting of preferably white paper 10 with adhesive coating on the underside and for instance silicone-treated underpaper 11, the contour of the lid 6 is punched out from one side of the sheet on the white paper. A circle having a smaller diameter than that of the closing part 7 is punched out on the underpaper 11 from the other side of the sheet and also a contour positioned under the contour of the grip tap 8 of the lid, and this latter contour is preferably positioned somewhat inside at least the free end of the grip tap, in order to hereby facilitate the removal of the lids from the sheet. A part of a sheet is shown in FIG. 4 with two of the punched-out lids still in place in the right row (the two at the top) and holes in the rest of the sheet remaining after lids have been removed from the sheet. The manufacture can take place very rapidly and simply by an appropriate tool, and required data, e.g. the name and date of birth of a patient, type of medicine, dosage, etc., can in a simple way be printed or stamped on the lids before the removal of the lids from the sheet or on the removed lids.

Figure 5:
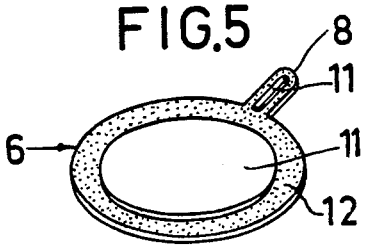
FIG. 5 is a perspective view illustrating a lid.

A lid 6 removed from the sheet 9 is shown in FIG. 5 with the underpaper 11 on the underside of the closing part 7 of the lid and on the grip tap 8. The underpaper under the closing part 7 of the lid leaves an adhesive peripheral edge area 12 for adhesion on the upper edge 3 upon the closing of the medicine space of the cup and the underpaper facing the space prevents medicine from adhering to the lid. The underpaper under the grip tap 8 prevents the grip tap from adhering to the fingers upon closing and opening the lid. Moreover, the underpaper reinforces the lid.

In an alternative embodiment of the lid the underpaper under the closing part 7 of the lid and under the grip tap 8 can be punched out in one piece.

Figure 6:
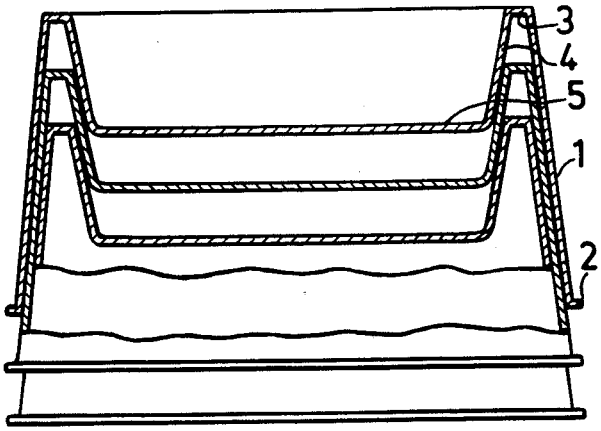
FIG. 6 is a view, partly in section, illustrating several cups without lids piled on each other.

FIG. 6, finally, illustrates cups piled on each other before they have been provided with lids, for instance as they are delivered together with sheets 9 and/or stored.

The cups are preferably made of transparent plastic material. Moreover, the cups can be made in different colors in order to keep different kinds of medicine separated. The cup can furthermore, in alternative embodiments have a cross section other than circular. Although cups according to the invention are particularly made in order to obtain an advantageous and appropriate configuration for portioning medicine, such cups can also with advantage be used in other applications.

I claim:

1. A pileable medicine cup, particuarly intended to be used for portioning medicine in a solid state, comprising an outer wall having a cross section which conically decreases from a bottom edge towards a top edge, said bottom edge surrounding an open bottom; an inner wall integral with said outer wall at said top edge, said inner wall being located within said outer wall and having a cross section which conically decreases from said top edge towards said open bottom, said inner wall merging into a closed bottom which is spaced from said open bottom by a distance that is at least one-half the total distance between said top edge and said open bottom, said closed bottom being substantially parallel to the plane of said open bottom; and a lid adhesively but removeably abutting said top edge; said inner wall, said closed bottom and said lid defining a closed space for medicine, and the spacing between said closed bottom and said lid being so related to the conical angle of said outer wall that when a plurality of said medicine cups are piled one upon another, the closed bottom of one cup abuts the lid of an underlying cup and the said outer wall of said one cup below its said closed bottom is positioned closely adjacent and parallel to the outer wall of said underlying cup.

2. The cup of claim 1 wherein said lid is fabricated of sheet material, only that side of said lid that faces said closed space being provided with an adhesive for removably attaching said lid to said top edge of the cup.

3. The cup of claim 2 wherein said adhesive on said side of said lid is partially covered by a layer of nonadhesive material that leaves said adhesive exposed for attachment to said lid only around a peripheral portion of said lid.

4. The cup of claim 1 wherein said lid is provided with a grip tab that extends outwardly of said lid beyond said outer wall, said grip tab being adapted to be bent downwardly to abut against the inside of the outer wall of an overlying cup when a plurality of said cups are piled upon one another.

5. The cup of claim 4 wherein the side of said lid and grip tab that faces said closed bottom is provided with an adhesive material, the portion of said adhesive material on said grip tab being covered by a layer of nonadhesive material.

6. The cup of claim 3 or 5 wherein said nonadhesive material is silicone treated paper.

* * * * *